United States Patent [19]

Vertegaal

[11] 4,288,212

[45] Sep. 8, 1981

[54] METHOD AND APPARATUS FOR FIXING A BINDING AGENT

[75] Inventor: Jacobus G. Vertegaal, Boxmeer, Netherlands

[73] Assignee: Stork Brabant B.V., Netherlands

[21] Appl. No.: 26,404

[22] Filed: Apr. 2, 1979

Related U.S. Application Data

[63] Continuation-in-part of Ser. No. 871,927, Jan. 24, 1978, abandoned.

[51] Int. Cl.[3] ..... F26B 13/00; F27B 9/28

[52] U.S. Cl. ..... 432/8; 432/59; 34/124; 26/18.5; 118/60; 118/67; 8/647; 427/381; 427/389.9

[58] Field of Search ..... 34/155, 124, 208; 432/59, 8; 68/5 D, 5 E, 20; 101/470; 118/59, 60, 67, 68; 26/18.5; 28/281; 38/2; 427/389.9, 381; 8/2.5 A

[56] References Cited

U.S. PATENT DOCUMENTS

| | | | |
|---|---|---|---|
| 3,118,154 | 1/1964 | Osbon et al. | 68/5 X |
| 3,546,902 | 12/1970 | Sando et al. | 34/242 X |
| 3,860,388 | 1/1975 | Haigh | 8/2.5 A |
| 4,002,046 | 1/1977 | Jamin | 8/2.5 A |
| 4,116,022 | 9/1978 | Lopata et al. | 8/2.5 A |
| 4,138,945 | 2/1979 | Rejto | 8/2.5 A |

*Primary Examiner*—Michael R. Lusignan

*Attorney, Agent, or Firm*—Ostrolenk, Faber, Gerb & Soffen

[57] ABSTRACT

A method and apparatus for fixing the binding agent of a dye-stuff to a printed web of material by means of heat applied to the web within a treatment or polymerization chamber. The treatment time of the web is increased by effecting a loop formation of the web upon a slowly moving belt traveling within the treatment chamber. After the web is first introduced into the chamber, it is then heated. Thereafter, the loop formation takes place. Upon leaving the treatment chamber, the web is passed over a stationary, curved shape heated plate, which smooths the web.

8 Claims, 6 Drawing Figures

METHOD AND APPARATUS FOR FIXING A BINDING AGENT

CROSS REFERENCE TO RELATED APPLICATION

This is a continuation-in-part of Application Ser. No. 871,927, filed Jan. 24, 1978, now abandoned.

BACKGROUND OF THE INVENTION

The invention relates to an apparatus for and to a method of fixing or polymerizing the binding agent of a dyestuff to a printed web of material by means of heat. The web is introduced into a closed chamber, is subsequently deposited on moving support members and is brought to treatment temperature which, during the stay in the chamber, continues acting on the web. Thereafter, the web of material is discharged from the chamber. A method of this type is mostly carried out such that the web of material is conveyed via a number of support members embodied as guide rollers so as to obtain a large quantity of material per unit of capacity of the closed chamber.

Known methods have the drawback that the web of material is conveyed through the chamber with a certain tension, as a result of which there may occur undesired deformations in the web.

SUMMARY OF THE INVENTION

The present invention aims at providing a system in which the web is conveyed tension-free within the chamber in order to achieve fixation of the dyestuff mostly by polymerization.

The aim of the apparatus described above is to obtain a polymerization or a polycondensation of the binding agent of dyestuff of a printed web of material. As a result of this polymerization, the material treated will become color-proof and will obtain good washable properties. The treatment aimed at is carried out by means of heat. In connection therewith, it should be avoided as much as possible that the web of material in its path within the housing or treatment chamber be subjected to any extension. Experiments have proven that many materials undergo undesired deformations if they are subjected to a tensile stress. The apparatus according to the invention aims at providing a method in which the web is polymerized tension-free.

According to one aspect of the invention, the web to be treated is deposited on a supporting belt within the closed chamber. The velocity of the supporting belt is selected so that the velocity of supply and discharge of the web both exceed the traveling velocity of the supporting belt for promoting a tension-free formation of plaiting or loops.

After introducing the web into the housing or treatment chamber and prior to the web being placed on the belt, the web is heated by the heating means to such an extent that the web substantially obtains the treatment temperature desired. This temperature may thereafter be maintained by circulating hot ar. This is done to prevent differences of temperature during the loop formation and polymerization stages.

After coming off the supporting belt and before the web is discharged, the web is passed over a curved, or bent heated plate which completes the polymerization and smooths the web.

The invention comprises the combination of the three features mentioned above, the first of which, namely the formation of loops, is known in the textile industry, although not in connection with methods of this type. The simple application of the formation of loops in this method involves, however, the risk of the thermal treatment of the web not being uniform in all places, because the loops overlap each other partially. In view hereof, the second feature of the combination has been added, that is, the heating of the web immediately after it has entered the chamber to such an extent that the required treatment temperature is fully or practically fully arrived at. After the subsequent formation of loops, fixation of the dyestuff may take place evenly all over the length of the web of material available within the closed chamber.

For carrying out the method described above, the invention also relates to an apparatus for the thermal treatment of a web of material in a closed chamber, said apparatus comprising driven means for feeding the web into this chamber via an inlet, members for temporarily supporting and propelling the web, and driven means for discharging the web from the chamber via an outlet. In the present invention the support members comprise an endless belt driven at a lower velocity than that of the means for feeding and discharging the web in order to promote a tension-free formation of loops. The means for feeding the web to the supporting belt comprises web heating means just downstream in the path of the web from the inlet to the chamber.

In one embodiment of the invention, the web, prior to the formation of loops, is conveyed along the surface of a heatable drum. At least two guide rollers are so arranged that the web may contact the surface of the drum along an arc of more than 180°. The necessary transmission of heat may be realized within a very short period of time.

In another preferred embodiment of the invention, the web, prior to the formation of loops is conveyed through a longer heating up zone, and the web even doubles back as it is being heated before entering the polymerization zone. In the latter embodiment, the web is heated more gradually than in the former embodiment, which is less likely to damage the web.

The invention also relates to a method in which the web of material to be treated proceeds directly from a printing machine. One problem occurring in connection with this is that the operation of the printing machine has to be interrupted occasionally in which case the movement of the web of material comes to a standstill. Contact heating by the drum of the first embodiment may then cause excessive heating of the web of material. In order to avoid this, the present invention interrupts the contact between the web of material that is fed into the treatment chamber and the source of heat in case of the printing machine stopping.

In case of a temporary interruption in the supply of the web of material, the contact between the web and the heated drum should be discontinued as soon as possible in order to avoid superheating of the web. According to the invention, at least one of the guide rollers is pivotally supported and is so displaceable between two positions that the web in the one (active) position rests against the surface of the heatable drum and the web in the other (inactive) position remains entirely or substantially away from contact with the drum.

The invention relates particularly to the apparatus described above in combination with a printing machine coupled directly before the apparatus. The combination comprises a pulse transmitter which, at one end, is coupled with the drive of the printing machine and, at the other end, with both the pivotal guide roller and the heatable drum. Thus, in case the printing machine stops, the roller pivots to its inactive position, while the drum rotates backward in opposition to the normal motion of the web of material.

BRIEF DESCRIPTION OF THE DRAWINGS

FIG. 1 is a perspective elevational view of a first embodiment of the apparatus with a partly removed housing for showing the interior.

DESCRIPTION OF THE PREFERRED EMBODIMENTS

Figure 7:
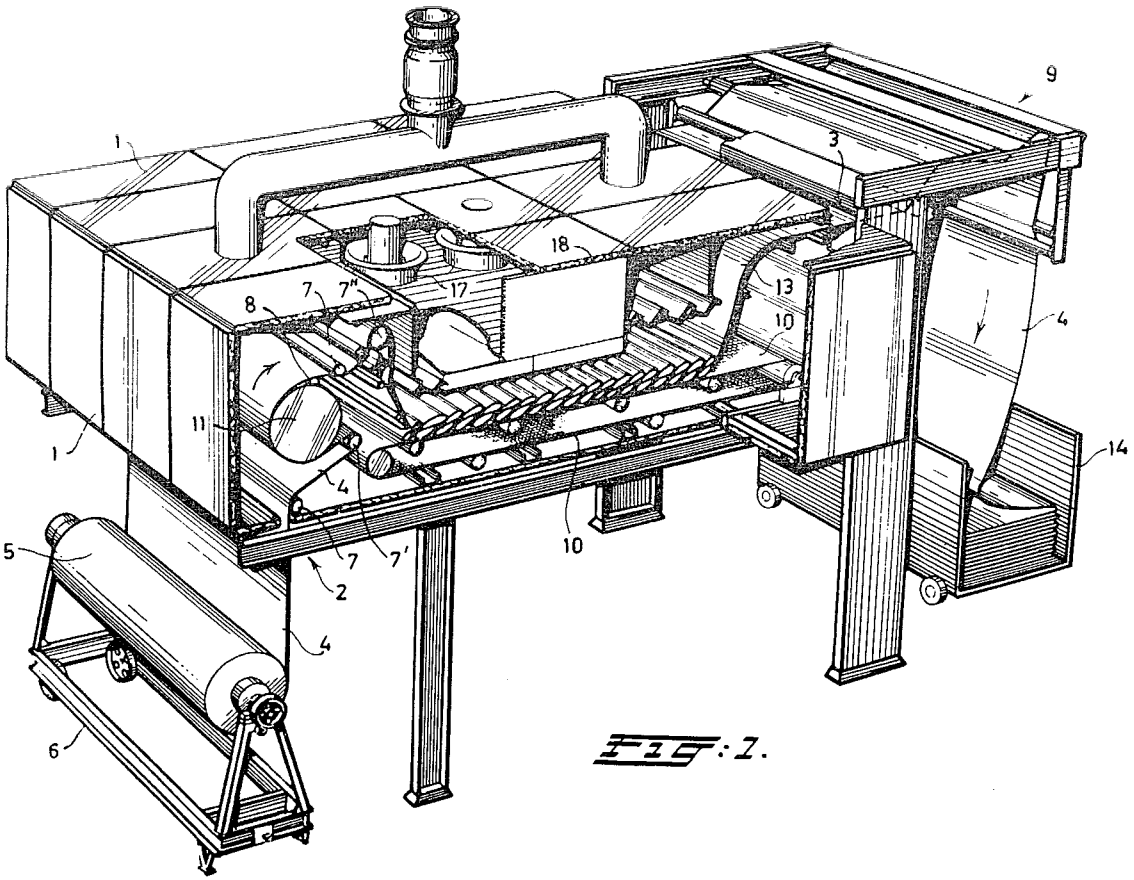

As can be seen in FIG. 1, the first embodiment of the apparatus comprises an insulated housing 1, which internally forms a closed chamber. This housing has an inlet 2 near the base and an outlet 3 remote therefrom for passing a web of material 4. This web may proceed from a reel 5 which is pivotally supported in a frame 6, but the apparatus will often be applied in combination with a printing machine, illustrated in FIG. 4, for instance a rotary screen printing machine coupled directly before the apparatus of the invention.

The apparatus comprises a plurality of guide rollers 7 and 8, the rollers 7 being provided with driving means for introducing the web 4 into the chamber via inlet 2 on the bottom near one side of the housing. Outside the housing 1, near the outlet 3 at the other side of the housing, there are driven means 9 for discharging the web 4 from the chamber.

In the chamber inside the housing 1, means are provided for temporarily supporting and propelling the web 4. These supporting means are formed by a driven endless belt 10 which consists of a perforated, for instance netted wire, material. The traveling velocity of this belt 10 is lower than the velocity of the upper guide roller 7″ shown in FIG. 1 which forms the feeding means of the web 4. The velocity of the discharge means 9 is equal to that of the rollers 7. As a result of the difference of velocities between the belt 10, on the one hand, and the feeding and discharge means on the other hand, the known phenomenon of formation of loops on the belt 10 occurs.

Figure 2:
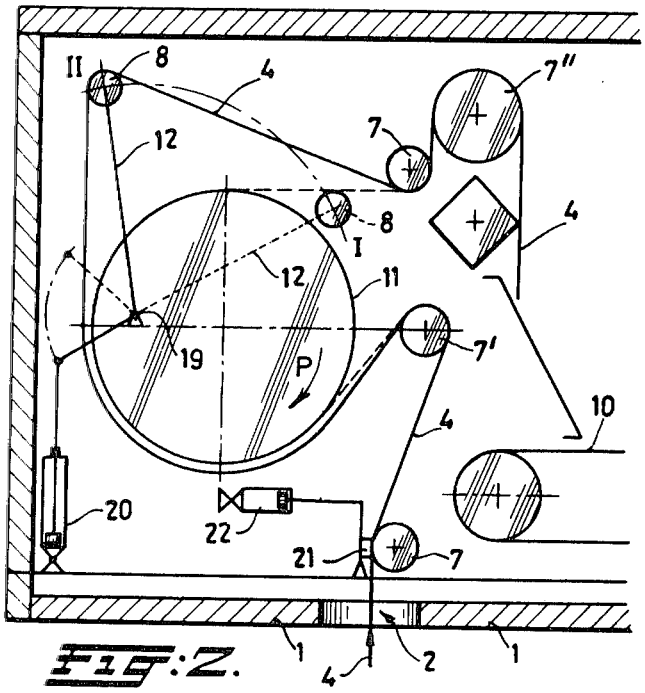
FIGS. 2 and 3 show two embodiments of a detail of the apparatus of FIG. 1.

Between the guide rollers 7, 8 of the web 4, a first embodiment of web heating means, namely the heatable drum 11, is rotatably mounted. The guide rollers 7′ and 8 are so arranged with respect to the drum 11 that during operation, the web 4 contacts the surface of the drum along an arc of more than 180°. The guide roller 8 is pivotally supported on a lever 12 and is so displaceable between two positions I and II such that the web 4 in the active position I illustrated in dotted lines in FIG. 2 rests against the surface of the drum 11. In the inactive position II illustrated in solid lines in FIG. 2, the web 4 remains entirely or substantially out of contact with the drum 11. As can be seen in FIG. 2, the pivotal guide roller 8 has a course of displacement which extends substantially above the drum 11.

FIG. 1 shows that in the zone between the endless supporting belt 10 and the outlet 3 there is a bent heatable plate 13 which the web of material 4 contacts during operations. This smooths and applies final heat to the web before it exits from the chamber. Finally, the treated web 4 is laid upon a tray 14.

Figure 4:
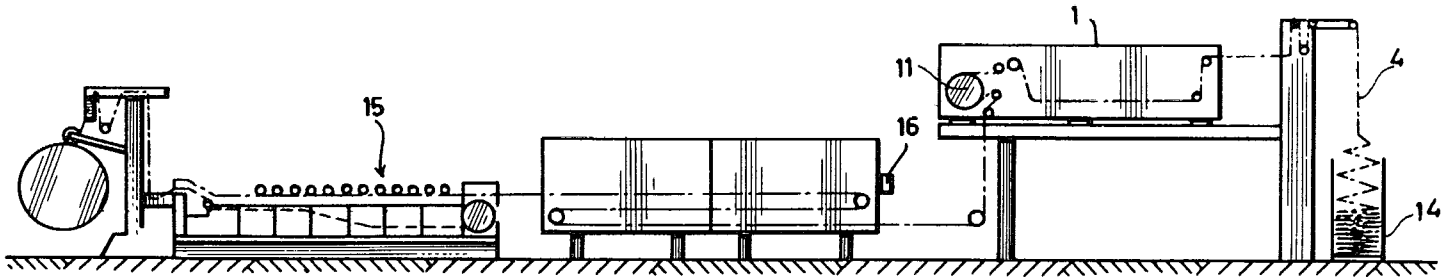
FIG. 4 shows a combined installation including the embodiment of FIG. 1.

As shown schematically in FIG. 4, the first embodiment of the present apparatus is applied preferably in combination with a printing machine 15, for instance a rotary screen printing machine of the type described in Dutch Patent Specification No. 134,267. Between the apparatus and said machine, a drying device is positioned. This combined installation comprises a pulse transmitter 16. The below described second embodiment of the present apparatus is also preferably applied in combination with a printing machine 15.

The lever 12 of the roller 8 is turned around a pivot 19 by means of a pneumatic cylinder 20. The drum 11 is connected to a drive (not shown) rendering it possible to rotate the drum in the direction of the arrow P, but also in the reverse direction. The guide roller 7 cooperates with a braking shoe 21 operated by a pneumatic cylinder 22.

The operation of the device shown in FIG. 2 is as follows: as soon as the traveling web 4 comes to a standstill, the pulse transmitter 16 sends a signal to the cylinders 22, 20 and to the drive of the drum 11. The first signal goes to the cylinder 22 which is actuated such that the shoe 21 holds the web 4 against the roller 7. Thereafter the drum 11 is counter-rotated over a predetermined short period, bringing the web 4 out of contact with the drum 11. Finally, the cylinder 20 is actuated by the transmitter 16 bringing the roller 8 from the active position I into the non-active position II. This latter situation is shown in full lines in FIG. 2.

When the operation of the apparatus is resumed, the brake shoe 21 is lifted, the guide rollers 7 are actuated and the cylinder 20 brings the roller 8 again into its position I shown in dotted lines in FIG. 2. The loop formation is hereafter continued on the endless supporting belt 10.

Once the web has obtained the desired subsequent treatment temperature from drum 11, the temperature is maintained by circulating hot air which is moved by the ventilator 17 which cooperates with the heating installation 18.

The control over the temperature is maintained by conventional means (not shown).

Figure 3:
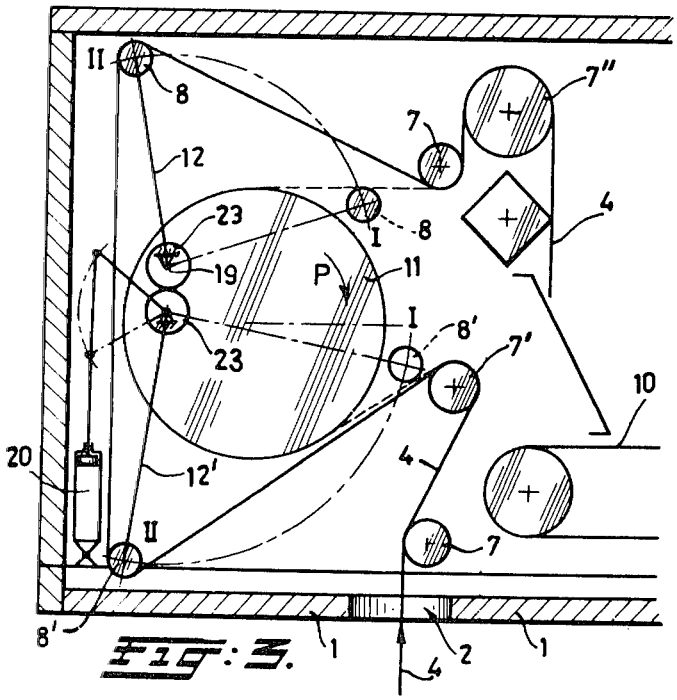

FIG. 3 shows a double embodiment for the guide rollers 8, 8′ and for their actuation. There are two levers 12, 12′ each having a pivot 19, 19′ and a pair of interengaging pinions 23. Both levers are actuated by the cylinder 20. In this embodiment, which operates substantially like the embodiment according to FIG. 2, no brake shoe 21 is required as both rollers 8, 8′ in their position II will keep the web 4 free from the drum 11.

It is observed that the velocity of the driven guide roller 7″ and of the discharge means 9 are adjustable and the velocity will generally be considerably lower than that of the means 7″ and 9, in order to obtain the formation of loops as illustrated. This also defines the dwelling time of the web 4 within the housing 1. Since, due to this formation of loops, the even heating of the web of material 4 give rise to problems (in fact, some parts of the loops are "hidden") the preheating drum 11 is so arranged that the web 4 will have been heated up to its treatment temperature prior to the formation of loops.

Figure 5:
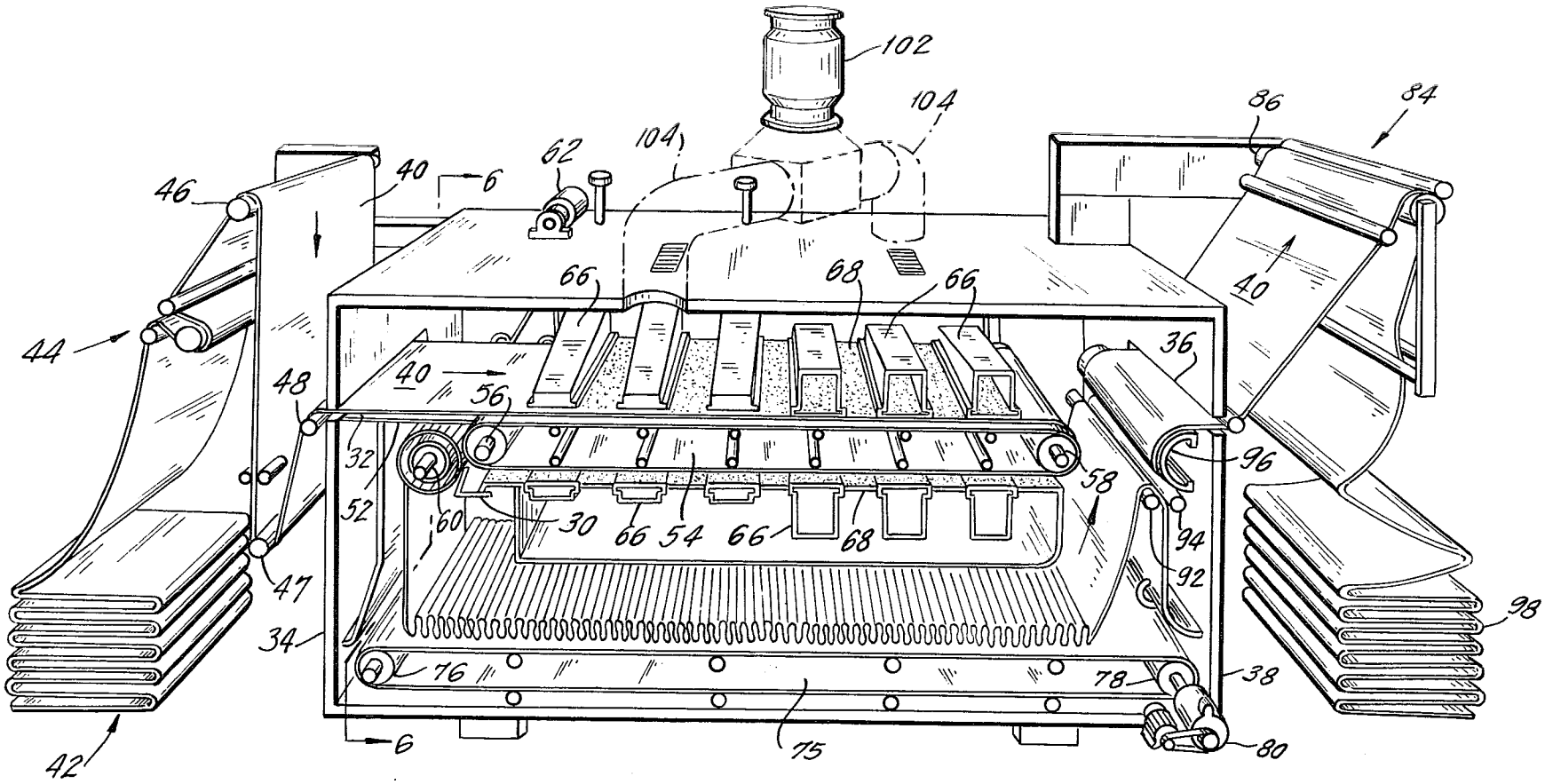
FIG. 5 is a side elevational view of a second embodiment of the apparatus, also with a partly removed housing.

Referring to FIG. 5 which shows the second embodiment of an apparatus according to the invention and which illustrates the second embodiment of a method according to the invention, the apparatus comprising an insulated housing 30 which is closed to internally form a closed chamber. The housing has an inlet slit 32 on the side 34 thereof and has an outlet slit 36 at the opposite side 38 thereof. The web of material 40 passes through the housing 30 from inlet to outlet. The web may proceed from a pile of plaited web material 42, over the tensioning roller assembly 44 and the rollers 46, 47 and 48 into the inlet 32. As this apparatus may be applied in combination with a printing machine, such as that illustrated in FIG. 4, the web material may come directly from a printing machine or from a dryer and may come plaited or straight or may arrive in batches.

Figure 6:
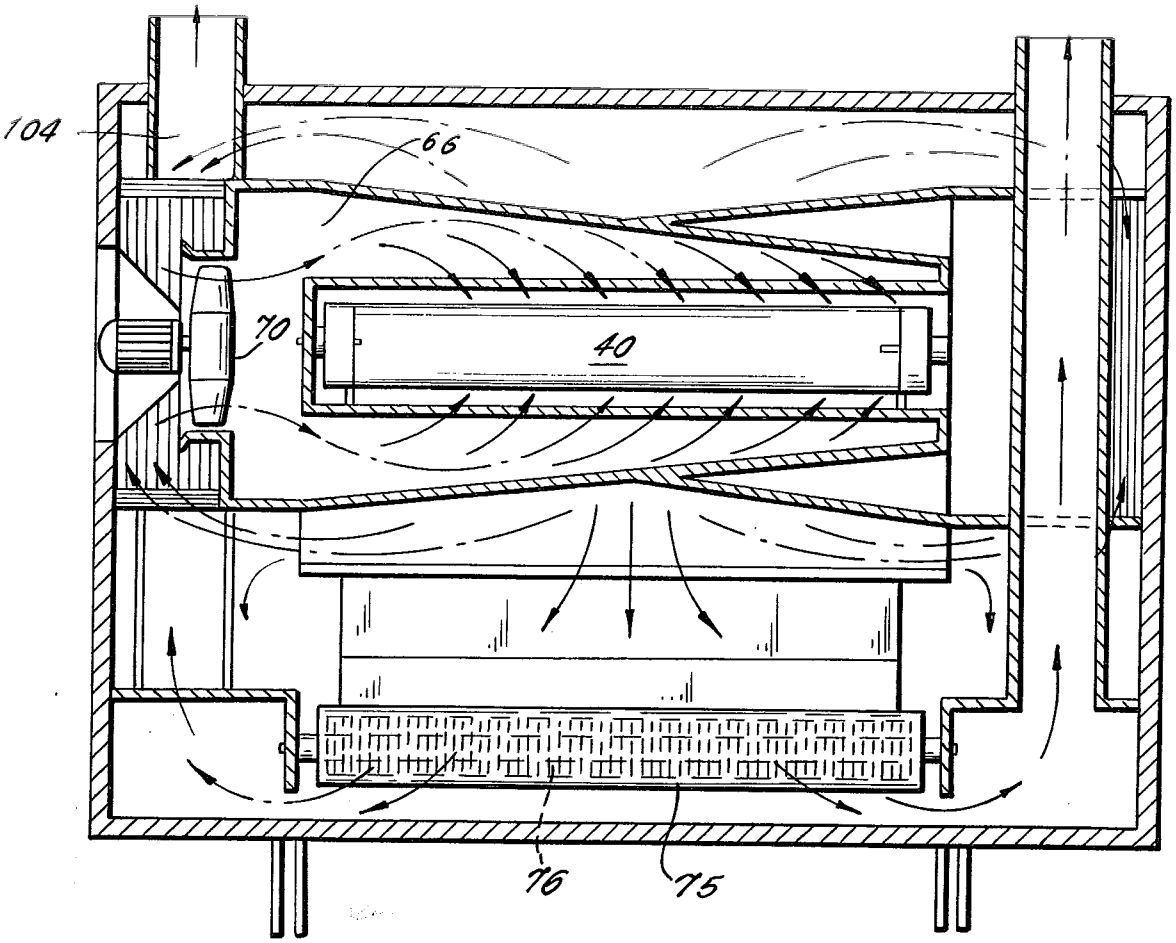
FIG. 6 is an end view, in cross-section, along the line 6—6 of FIG. 5.

Inside the housing 30, nearer the top thereof is the web heating up zone. In this zone, the web 40 moves over the stationary tray 52 and onto the endless conveyor belt 54 which passes about the rollers 56 and 58 which stretch the belt 54 taut. The web is brought to the desired temperature in the course of its two passes through the heating-up zone, one along the upper run of the belt 54 and one along the lower run of the belt 54. The web is immediately thereafter fed over the redirecting roller 60 from which the web then travels to the polymerization zone, described below. Drive means 62 drives the rollers 56 and 60 in tandem together for ensuring the proper speed for the belt 54 and the web 40 thereon through the initial heating-up zone. In the heating-up zone, the web 40 is exposed to hot air that is blown through the hot air conduits 66 which overlie the porous screen 68 above the web. A recirculation fan 70 blows heated air through the conduit 66 over the web 40. As shown by the arrows in FIG. 6, the heated air is recirculated. However, air that has passed through the below-described polymerization zone is preferably exhausted, as described further below and as also shown in FIG. 6. In the heating-up zone, the web is heated to the desired temperature before it nest passes through the polymerization zone. In the first embodiment, the heating-up is accomplished in a relatively short distance over the roller 11. In the second embodiment, the heating-up is accomplished much more slowly and without direct heating contact between the web and a drum, whereby minimizing damage to the web during heating-up.

The web now passes to the polymerization zone toward the bottom of the housing 30. In the polymerization zone, there is a relatively slower moving conveyor belt 75 that passes between and is held taut by the end supporting rollers 76 and 78. The drive means 80 drives the roller 78 and thereby the belt 75 in a direction which causes the web to move to the right in FIG. 5 through the polymerization zone. The web 40 coming off the roller 60 is laid naturally on the belt 75. The speed of the belt 75 is selected to be somewhat slower than the speed of the belt 54 and roller 60 so that as the web is laid on the top of the belt 75, it becomes looped or plaited, as illustrated. The web is therefore led through the polymerization zone at independently adjustable speed. While traveling through the polymerization zone, the web continues to be heated. Polymerization also occurs while heated air is flowing over the web to be polymerized. The heated air passes over and through the web for polymerizing it. Polymerization temperature can be regulated by a thermostat (not shown). If the measured cloth temperature is lower than that required for polymerization, heaters (not shown) in the housing 30 are adjusted to increase the temperature of the heating-up air. Finally, if this temperature increase is insufficient, the in-feed speed of the web can be reduced. Part of the hot air from the heating-up zone is naturally led into the polymerization zone, as shown in FIG. 6, which holds the web at the required elevated temperature throughout the process.

Outside the outlet 36 from the housing 30 are a series of rollers 84 which are driven by drive means 86 at a speed about that of the belt 54, so that the web 40 is extracted from the housing 30 at or about at the speed that it enters the same.

Dwell time in the polymerization zone can be regulated. Once the dwell time has been set, it is maintained at a constant value under all circumstances, even when changes take place in the heating up zone. Means (not shown) for coordinating the movement of the in-feed conveyor and the conveyor belt 54 and of the discharge device 84 as well as the belt 75 assure that the web stays as long as the dyestuff.

At the end of the polymerization zone and before the web leaves through the exit 36, the web 40 passes the rollers 92 and 94 which redirect the web to pass over the convexly curved heated plate 96. This heated plate smooths the web before it exits from the chamber 30. The web then passes over the extraction roller means 84 and is plaited at 98.

In addition to the recirculating fan 70, there is also exhaust means 102 which communicate with the exhaust conduits 104 to continuously remove used process air. This further ensures that any concentration of solvent fumes is kept well below a dangerous level. The arrangement of conduit 104 is such that heating air is recirculated, largely without being exhausted, but air which has passed over the web in the polymerization zone is more likely to be exhausted.

Although the present invention has been described in connection with preferred embodiments thereof, many variations and modifications will now become apparent to those skilled in the art. It is preferred, therefore, that the present invention be limited not by the specific disclosure herein, but only by the appended claims.

I claim:

1. An apparatus for the thermal treatment of a web of material in a closed chamber for the polymerization of the binding agent of a dyestuff on the web of material, the apparatus comprising: a closed chamber; the chamber having an inlet; first driven means for feeding the web into the chamber via the inlet at a predetermined velocity; the chamber having an outlet; second driven means for discharging the web from the chamber via the outlet, also at a predetermined velocity; a polymerization zone in which the binding agent may be polymerized, and comprising an endless belt for receiving the web thereon and located in the chamber between the inlet and the outlet, third drive means for driving the belt, at a lower velocity than the predetermined velocities of the first and second driven means for feeding and discharge of the web, for promoting a tension-free formation of loops of the web on the belt; the second driven means being located downstream of the endless belt in the path of travel of the web; a heatable, nonmoving plate within the chamber and positioned between the endless belt and the second driven means in the path of travel of the web, the plate having a convexly curved surface with respect to the travel of the web along its path of travel, web guiding means prior to the heatable plate in the path of the web of travel and located for pulling the web against the surface of the plate toward one end of the curved plate surface and the second means being located for pulling the web against the surface of the plate toward the other end of the curved plate surface, whereby the web is moved by the second drive means, and the web is guided by the web guiding means and the second driven means over and along the convexly curved surface of the plate with tensile stress for smoothing the web prior to discharge thereof.

2. The apparatus of claim 1, further comprising heating means located between the chamber inlet and the endless belt in the path of travel of the web through the chamber for heating the web prior to polymerization.

3. The apparatus of claim 2, wherein the heating means comprises: a second endless belt, with an upper and a lower run; means for moving the second endless belt substantially at the predetermined velocity; means for holding the web to move with the second endless belt along both the upper and lower runs thereof; means for blowing heated air over the web as it passes through both of the runs of the second endless belt.

4. The apparatus of claim 2, wherein the heating means comprises: a second belt; means for moving the second belt substantially at the predetermined velocity; means for holding the web to move with the second belt; means for heating the web as the web passes with the second belt.

5. The apparatus of claim 4, wherein the means for heating the web comprises means for blowing heated air over the web as the web passes with the second endless belt.

6. The apparatus of claim 3, further comprising recirculating fan means for recirculating the heated air through the heating means in the chamber.

7. A method of fixing the binding agent of a dyestuff to a printed web of material by means of heat comprising the steps of introducing said web into a closed chamber, subsequently depositing said web on moving support members and heating said web to treatment temperature, said temperature continues acting on the web during its stay within the chamber, whereafter discharging said web of material from the chamber, and depositing said web on a supporting belt within the closed chamber, the velocity of supply and discharge of the web exceeding the traveling velocity of the supporting belt for promoting a tension-free formation of loops, while, prior to depositing said web on the belt, heating said web to almost the treatment temperature by contact with a source of heat in order to prevent difference of temperature in the formation of loops.

8. The method of claim 7, wherein, prior to discharging said web from the closed chamber, conveying said web along a heated bent surface under a light tensile stress for eliminating a formation of folds, if any, during the preceding treatment.

* * * * *